US008746221B2

(12) United States Patent
Rentz

(10) Patent No.: US 8,746,221 B2
(45) Date of Patent: Jun. 10, 2014

(54) ARCHERY RELEASE FINGER

(75) Inventor: Marc T. Rentz, Madison Heights, VA (US)

(73) Assignee: Gregory E. Summers, Amherst, VA (US)

( * ) Notice: Subject to any disclaimer, the term of this patent is extended or adjusted under 35 U.S.C. 154(b) by 381 days.

(21) Appl. No.: 13/273,406

(22) Filed: Oct. 14, 2011

(65) Prior Publication Data

US 2013/0092140 A1 Apr. 18, 2013

(51) Int. Cl.
*F41B 5/18* (2006.01)
*F41B 5/14* (2006.01)

(52) U.S. Cl.
CPC ..... *F41B 5/1469* (2013.01)
USPC ..... 124/35.2; 124/1; 124/31; 124/86; 124/90

(58) Field of Classification Search
CPC ..... F41B 5/1473; F41B 5/1469
USPC ..... 124/31, 35.2, 86, 90, 1
See application file for complete search history.

(56) References Cited

U.S. PATENT DOCUMENTS 3,072,115 A * 1/1963 Johnson ..... 124/35.2
3,415,241 A * 12/1968 Bear ..... 124/23.1
3,815,270 A * 6/1974 Pachmayr ..... 42/71.02
4,043,066 A * 8/1977 Pachmayr et al. ..... 42/71.02
4,160,437 A * 7/1979 Fletcher ..... 124/35.2
4,232,649 A * 11/1980 Allen et al. ..... 124/35.2
4,346,530 A * 8/1982 Stewart et al. ..... 42/71.01
4,437,449 A * 3/1984 Attanasio ..... 124/22
5,070,856 A * 12/1991 Plummer ..... 124/88
5,465,520 A * 11/1995 Cupp ..... 42/71.02
5,560,136 A * 10/1996 Cupp ..... 42/71.02
5,621,997 A * 4/1997 Pearce ..... 42/71.02
5,666,936 A * 9/1997 Estrada ..... 124/35.2
5,694,915 A * 12/1997 Summers ..... 124/35.2
5,768,817 A * 6/1998 Simons ..... 42/71.02
5,867,868 A * 2/1999 Ward ..... 16/422
6,073,381 A * 6/2000 Farrar et al. ..... 42/71.02
6,125,833 A * 10/2000 Tentler et al. ..... 124/35.2
6,205,991 B1 * 3/2001 Summers et al. ..... 124/35.2
6,279,168 B1 * 8/2001 Bean ..... 2/209.13
6,481,431 B1 * 11/2002 Summers ..... 124/35.2
D478,494 S * 8/2003 Arnold ..... D8/107
6,651,642 B1 * 11/2003 Powers ..... 124/35.2
6,782,652 B1 * 8/2004 Erickson ..... 42/143
6,839,940 B2 * 1/2005 Harman ..... 16/110.1
6,951,046 B2 * 10/2005 Robinson ..... 16/431
6,957,644 B2 * 10/2005 Simo et al. ..... 124/35.2
7,119,304 B2 * 10/2006 Meyers ..... 219/204
7,253,348 B2 * 8/2007 Stanley ..... 84/328
7,284,546 B2 * 10/2007 Maki et al. ..... 124/35.2
7,654,254 B1 * 2/2010 Rentz et al. ..... 124/35.2
7,753,043 B1 * 7/2010 Eckert ..... 124/35.2
7,862,446 B2 * 1/2011 Huang ..... 473/300
8,181,378 B2 * 5/2012 Losinger ..... 42/85

(Continued)

*Primary Examiner* — Gene Kim
*Assistant Examiner* — Alexander Niconovich
(74) *Attorney, Agent, or Firm* — Leading Edge Law Group, PLC

(57) ABSTRACT

A back-tension archery release finger includes a housing containing a chamber which is adapted to receive a soft rubber insert. The housing includes at least one opening in a side wall thereof which communicates with the chamber to provide access to the insert. The insert projects through the side wall opening to define a contact surface for the finger of an archer. The housing may be contoured to match multiple fingers of the archer.

14 Claims, 2 Drawing Sheets

(56) References Cited

U.S. PATENT DOCUMENTS

| | | | | |
|---|---|---|---|---|
| 8,360,898 | B2 * | 1/2013 | Huang | 473/300 |
| 2008/0105246 | A1 * | 5/2008 | Marques et al. | 124/80 |
| 2008/0149084 | A1 * | 6/2008 | Whalen et al. | 124/35.2 |
| 2008/0183116 | A1 * | 7/2008 | Platt | 602/21 |
| 2012/0285431 | A1 | 11/2012 | Summers | |

* cited by examiner

ARCHERY RELEASE FINGER

BACKGROUND OF THE INVENTION

The present invention relates to a finger for an archery release, and more particularly to a release finger containing a rubber insert.

Release devices are used in archery to assist the archer in pulling a bowstring to a fully drawn position and then releasing the bowstring to fire an arrow. The release devices are typically formed from a rigid lightweight metal and include a housing for receiving the index finger of the archer and a trigger which is gripped by one or more of the archer's fingers. Because of the metal surface, there is a tendency for the archer's fingers to slip or slide on the trigger, causing the trigger to inadvertently actuate the release. The present invention relates to a release trigger which eliminates slipping of the archer's fingers.

BRIEF DESCRIPTION OF THE PRIOR ART

Back-tension release devices including trigger fingers are known in the art as evidenced by U.S. patent application Ser. No. 13/106,434. This application discloses a back-tension archery release which includes a handle with an adjustable sear housing and an adjustable finger. The handle has a longitudinal axis. The sear housing is adjustable about an axis normal to the handle axis to eliminate twist or torque in a bowstring loop connected with the release, and the finger is adjustable about the longitudinal axis to increase or decrease the speed of the release and provide an improved ergonomic feel to the user. In addition, the finger is removable from the handle so that differently configured fingers may be substituted by the user.

While the prior devices normally operate satisfactorily, the fingers are slippery and can lead to inadvertent actuation of the release, especially if sweat is present on the fingers of the archer following repeated firing of the release.

SUMMARY OF THE INVENTION

The present invention was developed in order to overcome these and other drawbacks of prior archery releases by providing a finger with a rubber insert which is exposed to the archer's fingers and thus prevent slipping. More particularly, the finger includes a housing which contains a chamber and at least one opening in a side wall of the housing. The opening communicates with the chamber. An insert formed of a resilient rubber material is arranged in the chamber with a portion of the insert accessible via the opening to define a contact surface for at least one finger of an archer.

The housing preferably contains a lip surrounding the opening to retain the insert within the chamber. The insert preferably has a cross-sectional configuration slightly greater than the opening to the chamber. Thus, a portion of the insert extends from the opening to define the contact surface.

In one embodiment, the insert is compressed for insertion into the chamber via the opening.

In a second embodiment, the housing contains an opening in an end thereof. The opening has a diameter corresponding with the diameter of the insert. The insert is inserted into the housing chamber via the opening in the end of the housing. A set screw is threadably connected with the opening to retain the insert in the chamber.

In a third embodiment, the insert is molded in the longitudinal chamber. More particularly, the insert is arranged in the chamber and then vulcanized to bond directly to the housing.

BRIEF DESCRIPTION OF THE FIGURES

Other objects and advantages of the invention will become apparent from a study of the following specification when viewed in the light of the accompanying drawing, in which.

DETAILED DESCRIPTION

Figure 1:
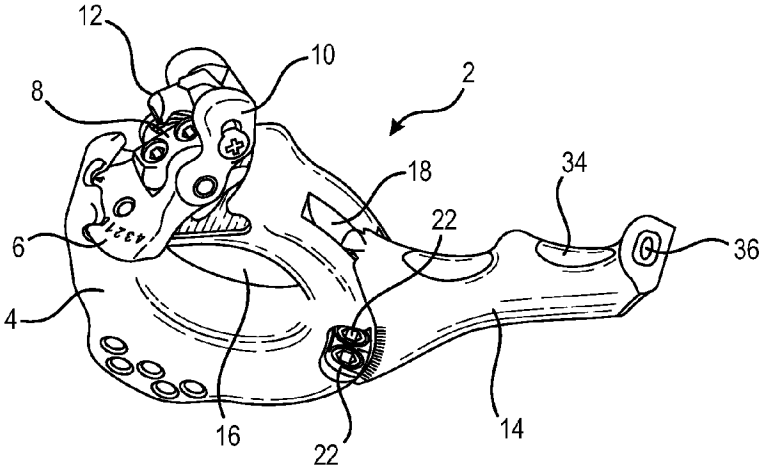
FIG. 1 is a front perspective view of the back-tension archery release and finger according to the invention.

Referring first to FIG. 1, a back-tension archery release 2 includes a handle 4 with which a sear housing 6 is rotatably connected. A sear 8 and sear cage 10 are connected with the sear housing and a hook 12 is connected with the sear housing. A finger 14 is connected with the handle and extends radially therefrom. In use, the hook engages the loop of a bowstring (not shown) and the release is operable to release the bowstring from the hook to fire an arrow.

The handle 4 contains a central opening 16 for receiving the index finger of an archer. The outer surface of the handle contains a slot 18 in a lower portion thereof. The slot accommodates the finger 14. More particularly, referring to FIG. 2, the finger 14 contains a stem 20 at one end which is contoured to fit within the slot 18. A pinch plate (not shown) fits within a slot of the finger stem and within a matching contoured portion of the slot 18 to adjustably connect the finger with the handle. A pair of screws 22 are provided to secure the finger stem 20 and pinch plate within the slot. When the screws are loosened, the finger stem can be shifted or moved within the slot about the axis of the handle to displace the finger relative to the outer surface of the handle toward or away from the sear. When the screws are tightened, the pinch plate within the finger stem slot draws the stem against the handle to lock the finger in position. Positioning the finger toward the sear housing will increase the speed of the release. Positioning the finger away from the sear housing will decrease the speed of the release. The finger can also be positioned in accordance with the preferred ergonomic position of the user. The finger contains markings 24 such as engraved marks to provide an indication of the position of the finger to the user for proper adjustment of the finger relative to an indicator on the handle so that the user can consistently adjust the finger to a desired position.

In a preferred embodiment, the finger 14 is contoured to accommodate the other fingers of the archer's hand. In the embodiment shown in FIG. 2, the finger 14 accommodates two additional fingers. In the embodiment shown in FIGS. 3 and 4, the finger 114 accommodates one additional finger. As will be developed below, a non-contoured finger 214 shown in FIGS. 5-8 accommodates any number of fingers. The finger 314 of FIG. 9 accommodates three additional fingers. Other contoured finger shapes may be provided if desired. Because the finger is removably connected with the handle via the screws 22 and pinch plate, it is a simple matter to replace a finger of one contour with a finger of a different contour. Whatever finger contour is selected, the finger is still adjustable relative to the handle to adjust the speed of the release.

Figure 2:
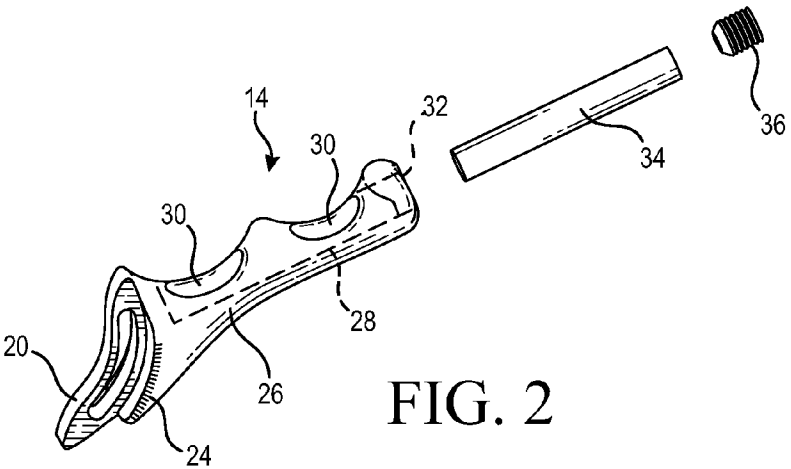
FIG. 2 is an exploded view of the finger the archery release of FIG. 1.

The finger shown in FIGS. 1 and 2 is formed of a lightweight rigid metal. It includes a housing 26 having a unitary construction and a longitudinal contoured configuration. The housing contains a longitudinal chamber 28 which is shown in phantom in FIG. 2. A pair of openings 30 in the side wall of the housing communicate with the chamber as will be developed below. The end wall of the housing also contains an opening 32 for receiving an insert 34. The insert is preferably formed of a soft rubber material which has non-skid properties. It has a cylindrical configuration and is inserted into the housing chamber 28 via the opening 32 in the end wall of the housing. The opening 32 is preferably of the same diameter as the insert and is threaded to receive a set screw 36 which closes the opening 32 and retains the insert within the housing chamber. The insert is easily replaced by removing the screw 36, removing a used insert, inserting a new insert, and replacing the screw.

The insert 34 projects through the openings 30 in the housing side wall to define contact surfaces for the fingers of the archer, other than the index finger which passes through the opening 16 in the handle 4. Because the insert is formed of a non-skid material such as rubber or synthetic plastic, the fingers of the archer do not slip on the finger of the release. This increases the precision of the release assembly, prevents inadvertent firing of the release, and prevents the release from slipping out of the archer's hand while in use.

Figure 3:
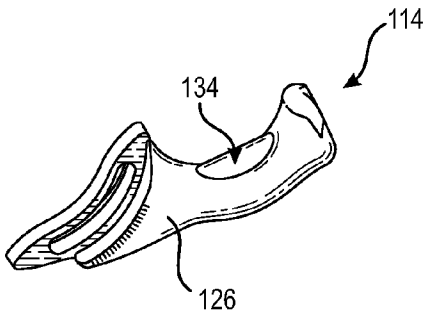
FIG. 3 is a perspective view of a finger according to an alternate embodiment.
Figure 4:
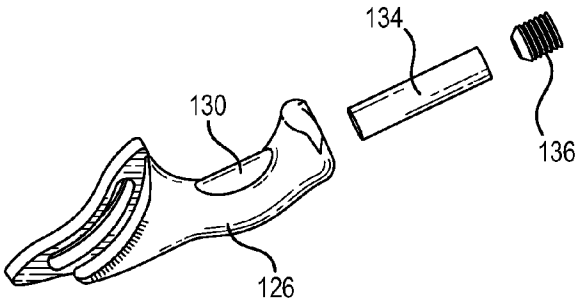
FIG. 4 is an exploded view of the finger of FIG. 3.
Figure 5:
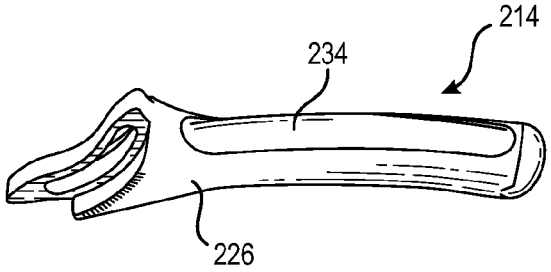
FIG. 5 is a perspective view of a finger according to a further embodiment.
Figure 6:
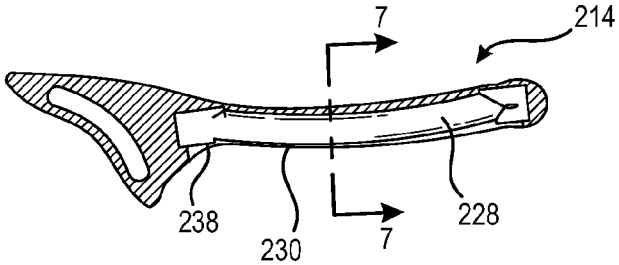
FIG. 6 is a sectional view of the finger of FIG. 5 with the insert removed.
Figure 7:
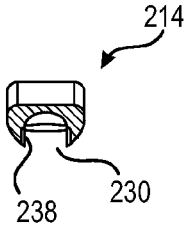
FIG. 7 is a sectional view taken along line 7-7 of FIG. 6.
Figure 8:
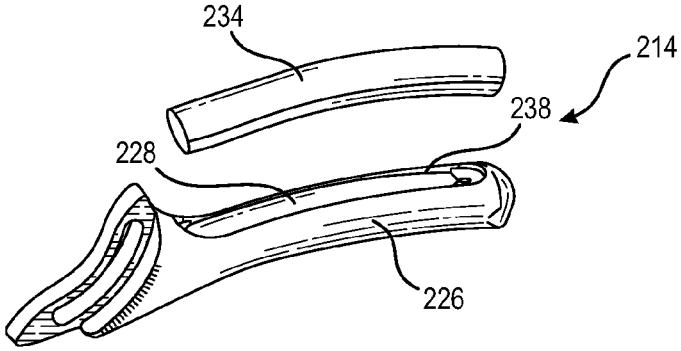
FIG. 8 is an exploded view of the finger of FIG. 5.

FIGS. 3 and 4 shows a finger 114 similar to that of FIGS. 1 and 2, but with a housing 126 that is contoured to accommodate only one additional finger of the archer. Accordingly, the housing contains only one opening 130 in the side wall. The insert 134 is inserted into the housing chamber via an opening (not shown) in the housing end wall. A set screw 136 closes the end wall opening and retains the insert in the housing chamber.

A finger 214 according to a further embodiment of the invention is shown in FIGS. 5-8. This finger is not contoured as are the fingers of FIGS. 1-4. It is thus used for multi-finger applications depending on the preference of the archer. The finger includes an elongated housing 226 which contains a longitudinal chamber 228 and a single opening 230 in a side wall thereof. An insert 234 is formed of soft rubber and is adapted for insertion in the housing chamber 228 via the side wall opening 230. The insert has an outer diameter which is slightly greater than the lateral dimension of the opening and a length that is slightly greater than the longitudinal dimension of the opening. In order to place the insert in the chamber, it is compressed slightly and squeezed through the opening into the chamber. Because the diameter of the insert is greater than the lateral dimension of the opening, a portion of the insert projects through the opening to define a contact surface for the fingers of the archer. In order to retain the insert within the chamber, the housing 226 has a lip 238 which extends around the perimeter of the opening 230.

Another method for installing the insert 234 into the chamber 228 of the finger housing utilizes a molding process. The insert is pressed into the chamber via the opening and then molded to the interior of the housing. A preferred molding technique is vulcanization which bonds the synthetic rubber insert to the metal of the finder housing. Such a technique provides both mechanical and chemical bonding of the insert within the housing to insure that the insert is not removed from the housing chamber during use.

Figure 9:
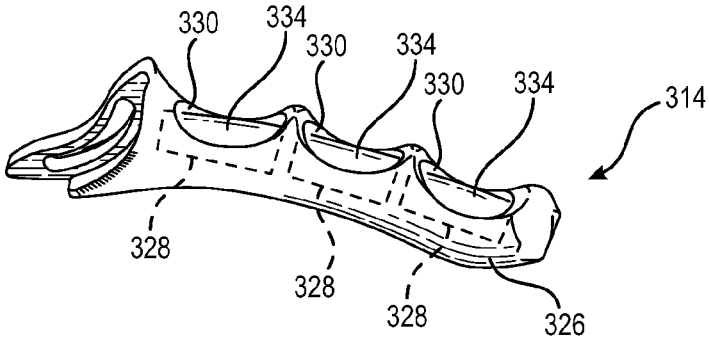
FIG. 9 is a perspective view of a finger according to a further embodiment.

A further embodiment of a release assembly finger 314 is shown in FIG. 9. This embodiment is similar to that shown in FIGS. 1-4 in that the housing 326 is contoured to accommodate a plurality of fingers of the archer. Rather than a single chamber, the housing contains a chamber for each finger. Thus, in the embodiment shown, three longitudinally extending chambers 328 are provided in end to end relation within the housing. The housing further includes three openings 330 in the side wall, each opening communicating with a respective chamber. Three separate inserts 334 of soft rubber material are arranged in the separate chambers, respectively. The inserts are placed into the chambers either via deformation or via molding, similar to the embodiments described above in connection with FIGS. 5-8.

In the embodiments of the invention shown in the drawing and described above, the finger has an elongated housing and contains a longitudinal chamber for receiving a generally cylindrical insert. This is to satisfy the requirements of the release assembly shown in FIG. 1. However, there are a wide variety of release assemblies which have elongated fingers. For example, some releases have U-shaped fingers. The present invention is suitable for such releases by providing a curved channel in the finger housing and a curved or U-shaped insert. The concepts of the invention are the same, with only the configuration of the housing chamber and insert being modified to match the configuration of the finger housing.

While the preferred forms and embodiments of the invention have been illustrated and described, it will become apparent to those of ordinary skill in the art that various changes and modifications may be made without deviating from the inventive concepts set forth above.

What is claimed is:

1. An archery release finger, comprising (a) an elongated housing containing a longitudinally extending chamber defining an inner surface of said housing, said housing further containing at least one first opening intermediate the ends of said housing and communicating with said chamber; and (b) an insert arranged in said housing chamber and engaging said housing inner surface, a portion of said insert being accessible via said first opening to define a contact surface of said insert for at least one finger of an archer.

2. An archery release finger as defined in claim 1, wherein said insert is formed of a non-skid material.

3. An archery release finger as defined in claim 2, wherein said insert is formed of soft rubber.

4. An archery release finger as defined in claim 3, wherein said housing contains a lip extending around the perimeter of said first opening for retaining said insert within said chamber.

5. An archery release finger as defined in claim 4, wherein said insert has a generally circular cross-sectional configuration.

6. An archery release finger as defined in claim 5, wherein said insert has an outer diameter greater than the lateral dimension of said first opening, whereby a portion of said insert extends from said opening to define said contact surface.

7. An archery release finger as defined in claim 6, wherein said insert has a length greater than the longitudinal dimension of said first opening.

8. An archery release finger as defined in claim 7, wherein said housing contains a second opening in one end portion thereof, said second opening communicating with said chamber and having a diameter corresponding with said insert for receiving said insert, whereby said insert can be positioned within said chamber.

9. An archery release finger as defined in claim 8, and further comprising a set screw removably connected with said housing for closing said second opening and retaining said insert within said chamber.

10. An archery release finger as defined in claim 2, wherein said housing is contoured to match the fingers of the archer, one opening and insert being provided to accommodate one finger of the archer, respectively.

11. An archery release finger as defined in claim 1, wherein said housing contains a plurality of longitudinally spaced chambers and openings connected therewith, respectively, and further comprising a plurality of inserts, one insert being arranged in each of said chambers, respectively.

12. An archery release finger as defined in claim 1, wherein said housing includes a flange at one end for adjustably connecting said finger with a release member.

13. An archery release finger as defined in claim 1, wherein said insert is molded within said chamber.

14. An archery release finger as defined in claim 13, wherein said insert is vulcanized for connection with said housing.

* * * * *